US011506989B2

(12) United States Patent
Yoshihara et al.

(10) Patent No.: US 11,506,989 B2
(45) Date of Patent: Nov. 22, 2022

(54) ELECTROSTATIC CHARGE IMAGE DEVELOPING TONER AND ELECTROSTATIC CHARGE IMAGE DEVELOPER

(71) Applicant: FUJIFILM Business Innovation Corp., Tokyo (JP)

(72) Inventors: Kotaro Yoshihara, Kanagawa (JP); Asafumi Fujita, Kanagawa (JP); Narumasa Sato, Kanagawa (JP); Teppei Yawada, Kanagawa (JP); Motoko Sakai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 42 days.

(21) Appl. No.: 15/930,919

(22) Filed: May 13, 2020

(65) Prior Publication Data

US 2021/0157249 A1 May 27, 2021

(30) Foreign Application Priority Data

Nov. 26, 2019 (JP) ..... JP2019-213153

(51) Int. Cl.
*G03G 9/097* (2006.01)
*G03G 9/08* (2006.01)

(52) U.S. Cl.
CPC ..... *G03G 9/0819* (2013.01); *G03G 9/0821* (2013.01); *G03G 9/0827* (2013.01); *G03G 9/09716* (2013.01); *G03G 9/09725* (2013.01)

(58) Field of Classification Search
CPC ..... G03G 9/09733
See application file for complete search history.

(56) References Cited

U.S. PATENT DOCUMENTS

2005/0164109 A1 7/2005 Iizuka et al.
2008/0227015 A1* 9/2008 Nagatomo ..... G03G 9/0902 430/109.4
2011/0294059 A1* 12/2011 Mogi ..... G03G 9/08795 430/108.22
2014/0220488 A1* 8/2014 Hosoya ..... G03G 13/08 430/119.71
2016/0179024 A1* 6/2016 Nishikawa ..... G03G 9/08755 430/108.7
2017/0090324 A1* 3/2017 Kadonome ..... G03G 9/0819

FOREIGN PATENT DOCUMENTS

JP 2005-215179 A 8/2005

* cited by examiner

*Primary Examiner* — Peter L Vajda
(74) *Attorney, Agent, or Firm* — Sughrue Mion, PLLC

(57) ABSTRACT

An electrostatic charge image developing toner includes toner particles having an average circularity of 0.96 to 1.00 and organic particles having an aspect ratio of 0.4 to 0.9 as an external additive.

19 Claims, 5 Drawing Sheets

ELECTROSTATIC CHARGE IMAGE DEVELOPING TONER AND ELECTROSTATIC CHARGE IMAGE DEVELOPER

CROSS-REFERENCE TO RELATED APPLICATIONS

This application is based on and claims priority under 35 USC 119 from Japanese Patent Application No. 2019-213153 filed on Nov. 26, 2019.

BACKGROUND

(i) Technical Field

The present invention relates to an electrostatic charge image developing toner and an electrostatic charge image developer.

(ii) Related Art

A method for visualizing image information, such as electrophotography, has been currently used in various fields. In electrophotography, an electrostatic charge image is formed as image information on the surface of an image holding member through charging and then forming an electrostatic charge image, a toner image is formed on the surface of the image holding member with a developer containing toner, the toner image is transferred onto a recording medium, and then the toner image is fixed on the recording medium. Through these steps, the image information is visualized as an image.

For example, JP-A-2005-215179 discloses an electrostatic charge image developing toner in which the toner mother particles have a shape factor SF1 is 140 or less, the external additive contains higher alcohol particles having a volume average particle diameter of 1 to 12 μm, and the content of higher alcohol particles having a volume average particle diameter not more than that of the toner mother particles is 0.15 parts by weight or more with respect to 100 parts by weight of the toner mother particles.

SUMMARY

Aspects of non-limiting embodiments of the present disclosure relate to an electrostatic charge image developing toner containing toner particles having an average circularity of 0.96 to 1.00 and organic particles, in which the electrostatic charge image developing toner prevents generation of density unevenness as compared with a case where the organic particles have an aspect ratio of less than 0.4, or a case where among the toner particles, a content of toner particles which have a particle diameter not less than a number particle diameter D84p, which is a particle diameter when a cumulative percentage reaches 84% in a cumulative frequency based on the number of the toner particles having the organic particles attached to or mixed with in terms of a circle equivalent diameter, and have an average circularity of 0.90 or less, provided that the average circularity is based on the toner particles having the organic particles attached to or mixed with, is less than 2.0% by number or more than 10.0% by number with respect to entire toner particles.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrostatic charge image developing toner including:

toner particles having an average circularity of 0.96 to 1.00; and organic particles having an aspect ratio of 0.4 to 0.9 as an external additive.

BRIEF DESCRIPTION OF THE DRAWINGS

Exemplary embodiments of the present invention will be described in detail based on the following figures, wherein.

DETAILED DESCRIPTION

Figure 1:
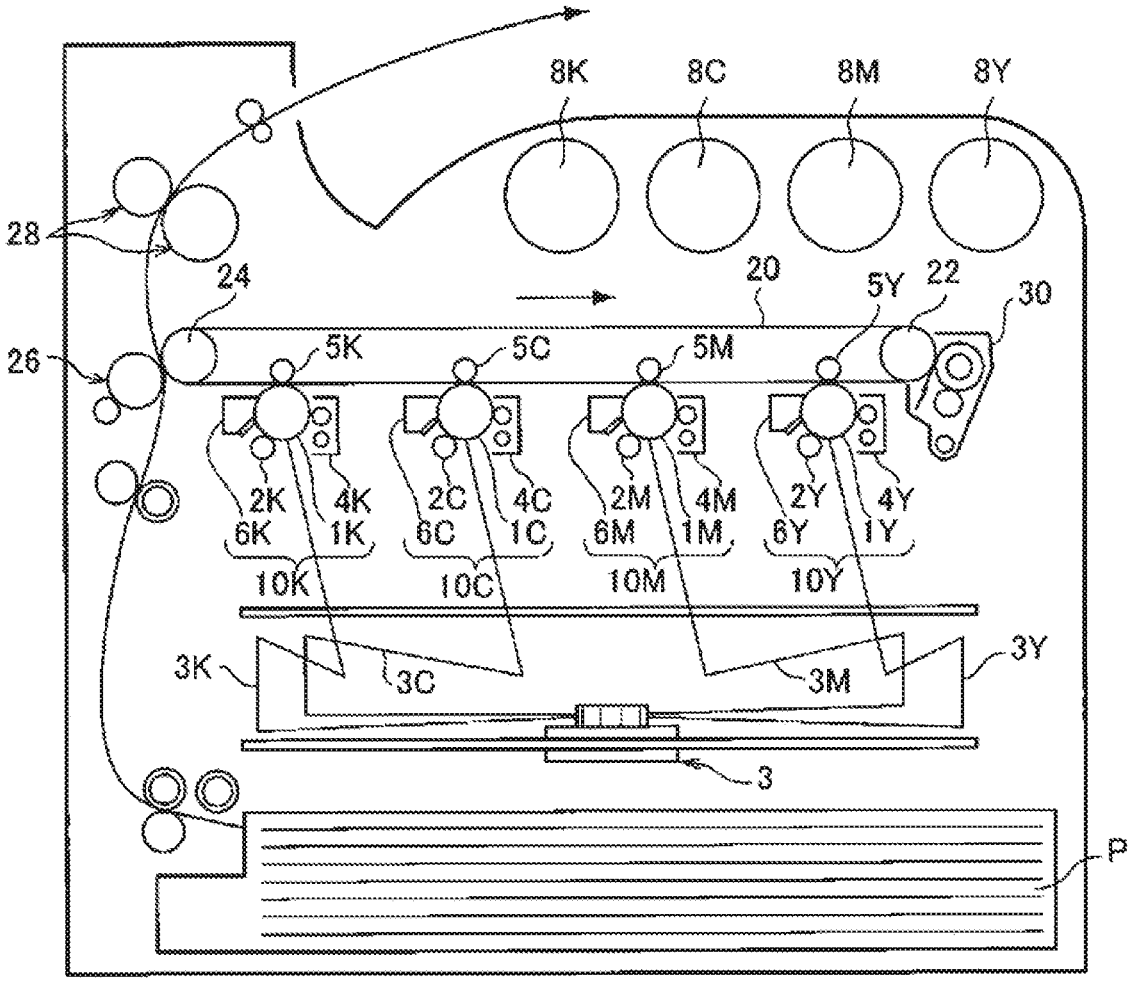
FIG. 1 is a schematic configuration diagram illustrating an example of an image forming apparatus according to an exemplary embodiment.

Hereinafter, exemplary embodiments which are examples of the present invention will be described in detail.

In a numerical range described in steps, an upper limit or a lower limit described in a certain numerical range may be replaced with an upper limit or a lower limit of another numerical range described in steps.

Further, in the numerical range, the upper limit or the lower limit described in a certain numerical range may be replaced with the value described in examples.

In a case where there are a plurality of substances corresponding to each component in the composition, the amount of each component in a composition means a total amount of the plurality of substances present in the composition, unless otherwise specified.

The term "step" includes not only an independent step but also other steps as long as the intended purpose of the step is achieved even if it is not able to be clearly distinguished from other steps.

<Electrostatic Charge Image Developing Toner>

An electrostatic charge image developing toner according to a first exemplary embodiment (hereinafter, referred to as a "toner") contains toner particles having an average circularity of 0.96 to 1.00; and organic particles having an aspect ratio of 0.4 to 0.9 as an external additive.

An electrostatic charge image developing toner according to a second exemplary embodiment (hereinafter, referred to as "toner") contains toner particles having an average circularity of 0.96 to 1.00, organic particles as an external additive, in which among the toner particles, a content of toner particles (hereinafter, also referred to as "irregular toner particles") which have a particle diameter not less than a number particle diameter D84p, which is a particle diameter when a cumulative percentage reaches 84% in a cumulative frequency based on the number of the toner particles having the organic particles attached to or mixed with in terms of a circle equivalent diameter, and have an average circularity of 0.90 or less, provided that the average circularity is based on the toner particles having the organic particles attached to or mixed with, is 2.0% by number to 10.0% by number with respect to entire toner particles.

The toner according to the first or second exemplary embodiment prevents generation of density unevenness by the above configuration. The reason is presumed as follows.

When an image having a low image density is continuously output, toner charging is slowly increased, and a phenomenon (hereinafter, also referred to as charge-up) in which the toner is excessively charged may occur.

When the charge-up occurs, the amount of developed toner is decreased and the image density is deteriorated. In such a case, the amount of development is sensed for the purpose of preventing the charge-up, and the amount of development is secured by controlling the toner density of a developer in a developing unit to be high.

On the other hand, in a high-temperature and high-humidity environment (for example, in an environment of 30° C. and 70% RH), if such a state in which the amount of developed toner continues to be decreased, the toner particles are subjected to a mechanical load in the developing unit to cause the external additives to be embedded in the toner particles, thereby remarkably deteriorating the toner developing property. Accordingly, higher toner density control is required.

The fluidity of the developer (or the toner contained in the developer) is deteriorated due to the embedding of the external additives and an increase in the toner density. As the reason for this, it is considered that spherical toner particles having an average circularity of 0.96 to 1.00 facilitate the closest packing between a toner and a carrier (refer to FIG. 4).

In a general developing unit, a layer regulating member is provided to supply an appropriate amount of a developer to a developing area. Then, in order to stabilize the amount of the developer supplied, the developer is retained in the layer regulating member. In a state where the fluidity of the developer is good, the developer retained in the layer regulating member is replaced; whereas in a case where the fluidity is deteriorated, the toner is hardly replaced, and the same developer continues to be retained.

In such a state, when an image having a high image density is output, the amount of developed toner is increased, and the toner density of the developer in a developing device is decreased, so that the bulk density of the developer is low, and thereby the developer retained in the layer regulating member is likely to be collapsed.

As a result, a developer having a low toner density and a developer having a high toner density are supplied to the developing area, and the developers having different developing properties are supplied, which may cause density unevenness. Particularly, in recent years, a diameter of the toner has been reduced, and the toner is more susceptible to the influence in the developing unit than the toner in the related art, and therefore, is more likely to cause the density unevenness.

A technique of externally adding spherical organic particles to a toner is also known. However, even if the spherical organic particles are externally added, it is considered that the toner particles, the spherical organic particles, and the carrier are likely to be closest packed (refer to FIG. 5), and the fluidity of the developer (or the toner contained in the developer) is deteriorated due to the embedding external additives and the increased density of the toner. Therefore, the density unevenness may occur.

In contrast, in the toner according to the first exemplary embodiment, organic particles having an irregular shape having an aspect ratio of 0.4 to 0.9 are externally added. The irregularly shaped organic particles externally added to the toner are less likely to rotate and interposed between the toner particle and the carrier, and the distance between the toner particle and the carrier is secured (refer to FIG. 3). As a result, it is difficult to achieve the closest packing, the bulk density of the developer is high, and the bulky state is maintained.

Therefore, even if the developer is retained in the layer regulating member, the developer is easily replaced, and the occurrence of the density unevenness is prevented.

On the other hand, the toner according to the second exemplary embodiment contains, among the toner particles, a specific amount of irregular toner particles which have a particle diameter not less than a number particle diameter D84p, which is a particle diameter when a cumulative percentage reaches 84% in a cumulative frequency based on the number of the toner particles having the organic particles attached to or mixed with in terms of a circle equivalent diameter, and have an average circularity of 0.90 or less, provided that the average circularity is based on the toner particles having the organic particles attached to or mixed with. That is, the combined shape of the organic particles and the toner particles contains a specific amount of the toner having a different shape. Therefore, the organic particles are interposed between the toner particle and the carrier, and the distance between the toner particle and the carrier is secured (refer to FIG. 3). As a result, it is difficult to achieve the closest packing, the bulk density of the developer is high, and the bulky state is maintained.

Therefore, even if the developer is retained in the layer regulating member, the developer is easily replaced, and the occurrence of the density unevenness is prevented.

From the above, it is assumed that the toners according to the first and second exemplary embodiments prevent the generation of density unevenness.

Note that, even when the toner according to the first and second exemplary embodiments is applied to a one-component developer, since the organic particles are interposed between the toner particles and the distance between the toner particles is secured, it is assumed that the generation of density unevenness is prevented.

Figure 3:
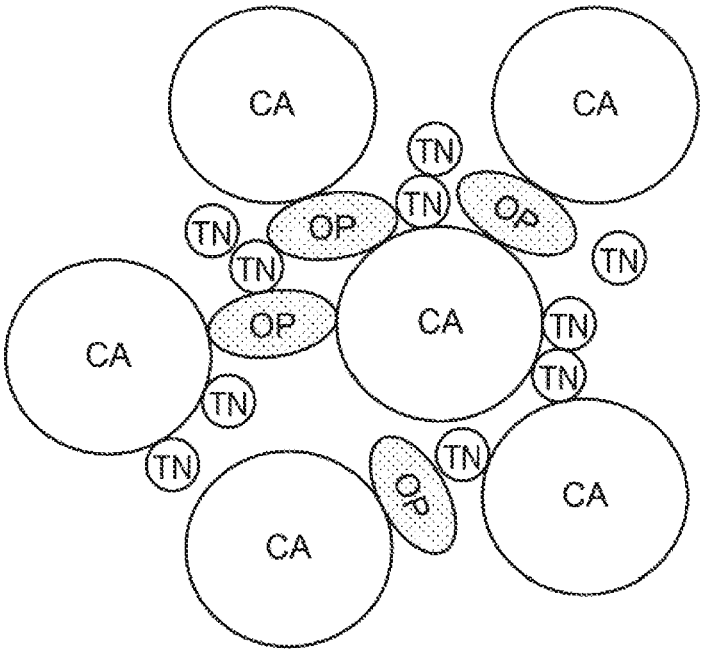
FIG. 3 is a schematic view illustrating an example of an electrostatic charge image developer including the electrostatic charge image developing toner according to the exemplary embodiment.
Figure 4:
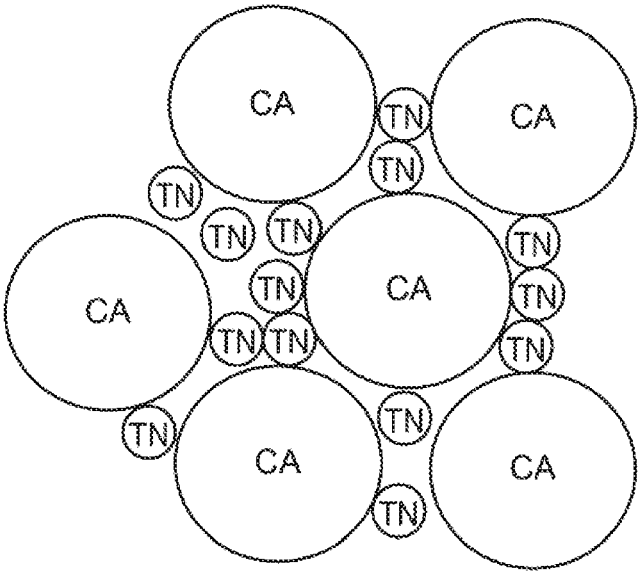
FIG. 4 RELATED ART
FIG. 4 is a schematic view illustrating an example of an electrostatic charge image developer in the related art.
Figure 5:
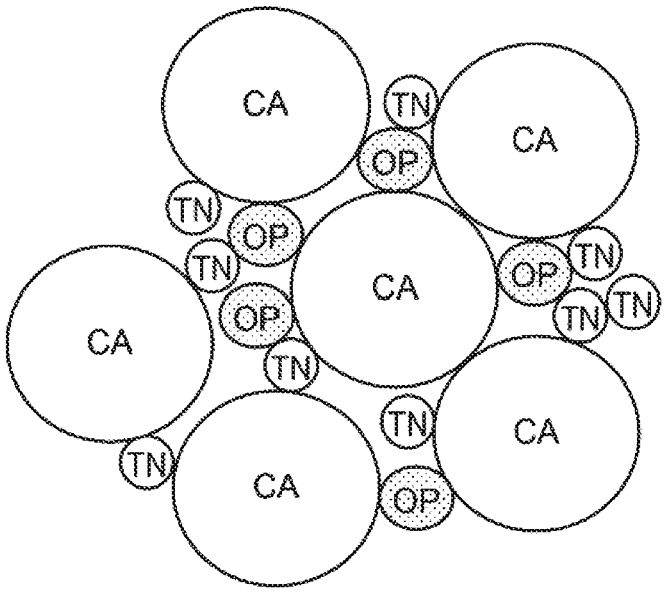
FIG. 5 RELATED ART
FIG. 5 is a schematic view illustrating another example of the electrostatic charge image developer in the related art.

Here, in FIGS. 3 to 5, TN represents a toner, OP represents an organic particle, and CA represents a carrier.

Hereinafter, the toners corresponding to the toners according to the first and second exemplary embodiments (hereinafter, also referred to as "toner according to the exemplary embodiment") will be described in detail. However, an example of the toner according to the exemplary embodiment of the invention may be a toner corresponding to one of the toners according to the first and second exemplary embodiments.

The toner according to the exemplary embodiment has toner particles and organic particles as an external additive.

(Toner Particles)

The toner particles include a binder resin. The toner particles may include a coloring agent, a release agent, and other additives.

—Main Properties of Toner Particles—

The average circularity of the toner particles is 0.96 to 1.00 (preferably, 0.96 to 0.98).

Even if the toner particles have a shape close to a sphere, the generation of density unevenness is prevented.

Note that, the average circularity of the toner particles indicates the average circularity of the toner particles alone.

The average circularity of the toner particles is determined by (circumferential length of equivalent circle)/(circumferential length) [(circumferential length of circle having the same projected area as the particle image)/(circumferential length of particle projection image)]. Specifically, the average circularity is a value measured by the following method.

First, toner particles to be measured are suctioned and collected, a flat flow is formed, a particle image is captured as a still image by flash emission instantaneously, and the particle image is analyzed by a flow type particle image analyzer (FPIA-3000 manufactured by Sysmex Corporation). In addition, the number of samplings for obtaining the average circularity is 3500.

In a case where the toner has an external additive, the toner (developer) to be measured is dispersed in water containing a surfactant, and then subjected to an ultrasonic treatment to obtain the toner particles from which the external additive has been removed.

Among the toner particles, the content of irregular toner particles (that is, toner particles which have a particle diameter not less than a number particle diameter D84p, which is a particle diameter when a cumulative percentage reaches 84% in a cumulative frequency based on the number of the toner particles having the organic particles attached to or mixed with in terms of a circle equivalent diameter, and have an average circularity of 0.90 or less, provided that the average circularity is based on the toner particles having the organic particles attached to or mixed with) is 2.0% by number to 10.0% by number (preferably 2.0% by number to 8.0% by number and more preferably 2.0% by number to 6.0% by number) with respect to entire toner particles.

The content of the irregular toner particles is measured as follows.

First, the "number particle diameter D84p" of the toner particles containing the organic particles is measured according to a method described later (refer to a method of measuring various average particle diameters of the toner particles).

The circularity and the circle equivalent diameter (a diameter of a circle having the same area) of the toner particles may be determined by a flow-type particle image analyzer (FPIA-3000 manufactured by Sysmex Corporation) that performs image analysis similarly to the circularity of the toner particles. The number of particles having an average circularity of 0.90 or less is determined by extracting particles having a number particle diameter D84p or more by analysis and further analyzing the average circularity of the irregular toner particles.

Thus, the number ratio of the irregular toner particles to the entire toner particles (total of the toner particles to which the organic particles are attached and the toner particles to which the organic particles are not attached) is obtained.

—Binder Resin—

Examples of the binder resin include a homopolymer of monomer such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethyl hexyl acrylate, methyl methacrylate, ethyl methacrylate, n-propyl methacrylate, lauryl methacrylate, and 2-ethyl hexyl methacrylate), ethylenically unsaturated nitriles (for example, acrylonitrile and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), olefins (for example, ethylene, propylene, and butadiene), or a vinyl resin composed of a copolymer obtained by combining two or more of these monomers.

Examples of the binder resin also include a non-vinyl resin such as an epoxy resin, a polyester resin, a polyurethane resin, a polyamide resin, a cellulose resin, a polyether resin, and a modified rosin, a mixture of these resins and the vinyl resin, or a graft polymer obtained by polymerizing a vinyl monomer in the coexistence.

These binder resins may be used alone, or two or more thereof may be used in combination.

As the binder resin, a polyester resin is preferable.

Examples of the polyester resin include known polyester resins.

Examples of the polyester resin include a condensation polymer of polyvalent carboxylic acid and a polyol. Note that, as the polyester resin, a commercially available product may be used, or a synthetic resin may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower (for example, 1 to 5 carbon atoms) alkyl esters thereof. Among these, as the polyvalent carboxylic acid, for example, aromatic dicarboxylic acid is preferable.

The polyvalent carboxylic acid may be used in combination with dicarboxylic acid and trivalent or higher carboxylic acid having a crosslinked structure or a branched structure. Examples of the trivalent or higher carboxylic acid include trimellitic acid, pyromellitic acid, anhydrides thereof, and lower (for example, 1 to 5 carbon atoms) alkyl esters thereof.

These polyvalent carboxylic acids may be used alone, or two or more thereof may be used in combination.

Examples of polyols include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, a bisphenol A ethylene oxide adduct and a bisphenol A propylene oxide adduct). Among these, as the polyol, for example, aromatic diols and alicyclic diols are preferable, and aromatic diols are more preferable.

As the polyol, tri- or higher polyol having a crosslinked structure or a branched structure may be used together with the diol. Examples of the tri- or higher polyol include glycerin, trimethylolpropane, and pentaerythritol.

These polyols may be used alone, or two or more thereof may be used in combination.

A glass transition temperature (Tg) of a polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

A weight average molecular weight (Mw) of the polyester resin is preferably from 5,000 to 1,000,000, and more preferably from 7000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and still further preferably from 60% by weight to 85% by weight, with respect to the entire toner particles.

—Coloring Agent—

Examples of the coloring agent includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

These coloring agents may be used alone, or two or more thereof may be used in combination.

As the coloring agent, if necessary, a surface-treated coloring agent may be used, or a dispersion may be used in combination. In addition, as the coloring agent, plural types of coloring agents may be used in combination.

The content of the coloring agent is preferably from 1% by weight to 30% by weight, and more preferably from 3% by weight to 15% by weight with respect to the entire toner particles.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and more preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably from 1% by weight to 20% by weight, and more preferably from 5% by weight to 15% by weight with respect to the entire toner particles.

—Other Additives—

Examples of other additives include well-known additives such as a magnetic substance, a charge controlling agent, and an inorganic powder. These additives are contained in the toner particle as internal additives.

—Properties of Toner Particles—

The toner particles may be toner particles having a single-layer structure, or may be a so-called core-shell structure composed of a core (core particle) and a coating layer (shell layer) covering the core.

Here, the toner particles having a core-shell structure include, for example, a core including a binder resin and other additives such as a coloring agent and a release agent as needed, and a coating layer including a binder resin.

The volume average particle diameter (D50v) of the toner particles is preferably 2 μm to 15 μm and more preferably 4 μm to 8 μm.

Note that, various average particle diameters and various particle diameter distribution indexes of the toner particles are measured using Coulter Multisizer Type II (manufactured by Beckman Coulter, Inc.) and an electrolytic solution is measured using ISOTON-II (manufactured by Beckman Coulter, Inc.).

In the measurement, a measurement sample of 0.5 mg to 50 mg is added to 2 ml of 5% aqueous solution of a surfactant (preferably sodium alkylbenzene sulfonate) as a dispersion. This is added to the electrolytic solution of 100 ml to 150 ml.

The electrolytic solution in which the sample is suspended is dispersed for 1 minute by an ultrasonic dispersion. Then, using the Coulter Multisizer II type, the particle diameter distribution of the particles having a particle diameter of from 2 μm to 60 μm is measured using an aperture having an aperture diameter of 100 μm. Note that, the number of particles to be sampled is 50,000.

The cumulative distribution of each of the volume and the number is drawn from the small particle side with respect to the particle diameter ranges (channels) separated based on measured particle diameter distribution, and in the cumulative distributions with respect to the volume and the number, the particle diameters when the cumulative percentage becomes 16% are defined as volume particle diameter D16v and number particle diameter D16p, respectively, the particle diameters when the cumulative percentage becomes 50% are defined as volume average particle diameter D50v and cumulative number average particle diameter D50p, respectively, and the particle diameters when the cumulative percentage becomes 84% are defined as volume particle diameter D84v and number particle diameter D84p, respectively.

Using these, a volume average particle diameter distribution index (GSDv) is calculated as $(D84v/D16v)^{1/2}$, and a number particle diameter distribution index (GSDp) is calculated as $(D84p/D16p)^{1/2}$.

The average circularity of the toner particles is preferably from 0.94 to 1.00, and more preferably from 0.95 to 0.98.

The average circularity of the toner particles is determined by (circumferential length of equivalent circle)/(circumferential length) [(circumferential length of circle having the same projected area as the particle image)/(circumferential length of particle projection image)]. Specifically, the average circularity is a value measured by the following method.

First, toner particles to be measured are suctioned and collected, a flat flow is formed, a particle image is captured as a still image by flash emission instantaneously, and the particle image is analyzed by a flow type particle image analyzer (FPIA-3000 manufactured by Sysmex Corporation). In addition, the number of samplings for obtaining the average circularity is 3500.

In a case where the toner has an external additive, the toner (developer) to be measured is dispersed in water containing a surfactant, and then subjected to an ultrasonic treatment to obtain the toner particles from which the external additive has been removed.

(External Additives)

Organic particles are applied as the external additive. As the external additives, external additives other than the organic particles may be used in combination.

The aspect ratio of the organic particles is from 0.4 to 0.9 (preferably from 0.4 to 0.8 and more preferably from 0.5 to 0.7). By applying the organic particles having this aspect ratio, the generation of density unevenness is prevented.

The average major axis of the organic particles is preferably from 3.0 μm to 11.0 μm, more preferably from 3.5 μm to 9.0 μm, and even more preferably from 4.0 μm to 8.5 μm, from the viewpoint of preventing generation of density unevenness.

The ratio (average major axis of organic particles/volume average particle diameter of toner particles) of an average major axis of the organic particles to a volume average particle diameter of the toner particles is preferably from 0.7 to 1.8, more preferably from 0.7 to 1.5, and even preferably from 0.7 to 1.2.

When the particle diameter ratio is within the above range, the closest packing between the toner particle and the carrier or between the toner particles is prevented, and the generation of density unevenness is easily prevented.

The aspect ratio and average major axis of the organic particles are measured as follows.

The toner is observed with a scanning electron microscope (SEM, manufactured by Hitachi High-Tech Corporation, product name: SU8010). Next, particle shape analysis of the observed organic particles is performed using attached image analysis software (manufactured by Mitani Corporation, product name: WinROOF). Then, the ratio (major axis/minor axis) of the major axis (that is, the maximum diameter of the particle) and the minor axis (that is, the maximum diameter in a direction orthogonal to the major axis) is obtained.

The average value of the ratio (minor axis/major axis) of 100 organic particles measured by this operation is defined as the aspect ratio of the organic particles.

In addition, the average value of the major axis of 100 organic particles measured by this operation is defined as the average major axis of the organic particles.

Examples of the organic particles include well-known resin particles such as higher alcohol particles, poly (meth) acrylate resin particles, polystyrene particles, polystyrene acrylic resin particles, fluorine resin particles (for example, polytetrafluoroethylene (PTFE) particles and the like), silicone resin particles, polyolefin resin particles, fatty acid metal salt particles, melamine cyanurate particles, and organic molybdenum compound particles. In addition, "(meth)acrylate" is an expression including both "acrylate" and "methacrylate".

Among these, higher alcohol particles are preferable as the organic particles.

As the higher alcohol particles, higher alcohol particles represented by Formula (AC) are particularly preferable. Since the higher alcohol particles have appropriate lubricity, the closest packing between the toner particle and the carrier or between the toner particles is prevented, and the generation of density unevenness is easily prevented.

$$CH_3(CH_2)_xCH_2OH \qquad \text{Formula (AC):}$$

In Formula (AC), x represents an integer of 20 to 80 (preferably from 20 to 65 and more preferably from 20 to 50).

In the differential scanning calorific curve of the organic particles, the onset temperature of the maximum endothermic peak during the temperature rise is preferably from 45° C. to 90° C., more preferably 50° C. to 90° C., and still more preferably 50° C. to 80° C.

When the onset temperature is within the above range, the surface layer of the organic particles becomes soft due to the temperature rise in the apparatus and the heat generated by a rubbing load. This makes it easier for the resin particles to be slowly attached to a carrier surface. Therefore, the closest packing between the toner particle and the carrier is prevented, and the generation of density unevenness is easily prevented.

The onset temperature is measured as follows.

The organic particles are collected from the toner by an ultrasonic treatment or the like.

Specifically, the organic particles are separated from the toner. There is no limitation on the method for separating the organic particles from the toner, and examples thereof include a sedimentation separation method and a centrifugation method. For example, after applying ultrasonic waves to a dispersion in which a toner is dispersed in water containing a surfactant, the dispersion is centrifuged at a high speed, and the toner particles, the organic particles, and other external additives are centrifuged according to specific gravity. The fraction containing organic particles is extracted and dried to obtain organic particles.

Using the collected organic particles as a sample, a differential scanning calorimetry (DSC) curve is obtained in accordance with ASTM D3418-8.

Specifically, 10 mg of organic particles to be measured are set in a differential scanning calorimeter (DSC-60A, manufactured by Shimadzu Corporation) equipped with an automatic tangential treatment system, and the temperature is raised to room temperature (25° C.) at a heating rate of 10° C./min) to 150° C. so as to obtain a temperature rising spectrum (DSC curve) in a first heating step.

The maximum endothermic peak having the highest peak temperature is specified from the obtained temperature rising spectrum (DSC curve). Here, the endothermic peak indicates a peak whose half width is within 15° C.

Then, the onset temperature of the specified maximum endothermic peak is measured.

Here, the onset temperature is defined as the temperature indicating an intersection A of a straight line obtained by extending the low-temperature-side base line of the specified maximum endothermic peak to the high-temperature side in the temperature rising spectrum (DSC curve) with a tangent drawn at the point (inflection point) where the gradient becomes maximum in the curve indicating the change in the amount from the start of endotherm of the specified endothermic peak to the top of the endothermic peak during the temperature rise.

From the viewpoint of preventing the generation of density unevenness, the external addition amount of the organic particles is preferably from 0.4% by weight to 2.0% by weight, more preferably from 0.4% by weight to 1.8% by weight, and even more preferably 0.5% by weight to 1.5% by weight with respect to the toner particles.

The organic particles may be controlled to a desired particle shape by preventing excessive pulverization by, for example, crushing spherical organic particles close to a desired particle diameter.

The organic particles are pulverized to some extent by a dry pulverizer, and formed into spherical particles by a wet treatment or a hot air treatment. The organic particles having a desired shape may be obtained by further subjecting the particles subjected to a spheroidization treatment to a dry pulverization treatment. In addition, even by pulverizing the layered structure compound by dry pulverization, the organic particles having a desired shape may be obtained.

Examples of other external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, and the like.

Among these, silica particles are preferable as other external additives from the viewpoint of preventing the generation of density unevenness. The volume average particle diameter of the silica particles is preferably from 20 nm to 200 nm and more preferably from 40 nm to 120 nm.

When the silica particles (particularly, silica particles having a volume average particle diameter of 20 nm to 200 nm) are externally added to the toner particles together with the organic particles, the silica particles are attached to the surface of the organic particles together with the toner particles, and thereby the fluidity of the toner is increased. Therefore, the closest packing between the toner particle and the carrier or between the toner particles is prevented, and the generation of density unevenness is easily prevented.

The external addition amount of the silica particles is, for example, preferably from 0.10% by weight to 10.0% by weight, more preferably from 0.10% by weight to 5.0% by weight, and even more preferably from 0.10% by weight to 2.5% by weight, with respect to the toner particles.

The surface of the inorganic particles as another external additive may be treated with a hydrophobizing agent. The hydrophobic treatment is performed, for example, by immersing the inorganic particles in a hydrophobizing agent. The hydrophobizing agent is not particularly limited, and examples thereof include a silane coupling agent, a silicone oil, a titanate coupling agent, and an aluminum coupling agent. These may be used alone, or two or more thereof may be used in combination.

The amount of the hydrophobizing agent is usually, for example, 1 part by weight to 10 parts by weight with respect to 100 parts by weight of the inorganic particles.

The external addition amount of the external additives is, for example, preferably from 0.01% by weight to 5% by weight and more preferably from 0.01% by weight to 2.0% by weight, with respect to the toner particles.

(Preparing Method of Toner)

Next, a preparing method of a toner according to the exemplary embodiment will be described.

The toner according to the exemplary embodiment is obtained by externally adding external additives to the toner particles after preparing the toner particles.

The toner particles may be prepared by any of a dry method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among these, the toner particles may be obtained according to the aggregation and coalescence method.

Specifically, for example, in a case where the toner particles are prepared by using the aggregation and coalescence method, the toner particles are prepared through the steps.

The steps include a step (a resin particle dispersion-preparing step) of preparing a resin particle dispersion in which resin particles constituting the binder resin are dispersed; a step (an aggregated particle forming step) of forming aggregated particles by aggregating the resin particles (if necessary, other particles) in the resin particle dispersion (if necessary, in the dispersion after mixing other particle dispersion); and a step (a coalescence step) of coalescing aggregated particles to form toner particles by heating an aggregated particle dispersion in which aggregated particles are dispersed, thereby preparing toner particles.

Hereinafter, the respective steps will be described in detail.

In the following description, a method of obtaining toner particles including the coloring agent and the release agent will be described, but the coloring agent and the release agent are used if necessary. Of course, other additives other than the coloring agent and the release agent may be used.

—Resin Particle Dispersion-Preparing Step—

First, a resin particle dispersion in which the resin particles constituting the binder resins are dispersed, a coloring agent particle dispersion in which coloring agent particles are dispersed, and a release agent particle dispersion in which the release agent particles are dispersed are prepared, for example.

Here, the resin particle dispersion is prepared, for example, by dispersing the resin particles in a dispersion medium with a surfactant.

Examples of the dispersion medium used for the resin particle dispersion include an aqueous medium.

Examples of the aqueous medium include water such as distilled water and ion exchanged water, and alcohols. These may be used alone, or two or more thereof may be used in combination.

Examples of the surfactant include an anionic surfactant such as sulfate, sulfonate, phosphate, and soap anionic surfactants; a cationic surfactant such as amine salt and quaternary ammonium salt cationic surfactants; and a nonionic surfactant such as polyethylene glycol, alkyl phenol ethylene oxide adduct, and polyol. Among them, the anionic surfactant and the cationic surfactant are particularly preferable. The nonionic surfactant may be used in combination with the anionic surfactant or the cationic surfactant.

The surfactant may be used alone, or two or more thereof may be used in combination.

Regarding the resin particle dispersion, as a method of dispersing the resin particles in the dispersion medium, a common dispersing method using, for example, a rotary shearing-type homogenizer, or a ball mill, a sand mill, or a Dyno mill as media is exemplified. Depending on the type of the resin particles, the resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersion liquids is also measured in the same manner.

The content of the resin particles contained in the resin particle dispersion is, for example, preferably from 5% by weight to 50% by weight, and more preferably from 10% by weight to 40% by weight.

For example, the coloring agent particle dispersion and the release agent particle dispersion are also prepared in the same manner as in the case of the preparation of the resin particle dispersion. That is, the details of the volume average particle diameter, the dispersion medium, the dispersing method, and the content of the particles in the resin particle dispersion are applicable to those of the coloring agent particles dispersed in the coloring agent particle dispersion and those of the release agent particles dispersed in the release agent particle dispersion.

—Aggregated Particles Forming Step—

Next, the resin particle dispersion, the coloring agent particle dispersion, and the release agent particle dispersion are mixed with each other.

The resin particles, the coloring agent particles, and the release agent particle are heterogeneously aggregated in the mixed dispersion, thereby forming aggregated particles having a diameter near a target toner particle diameter and including the resin particles, the coloring agent particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, from glass transition temperature of the resin particles−30° C. to glass transition temperature of the resin particles−10° C.) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersion to be added to the mixed dispersion, an inorganic metal salt, a divalent or more metal complex. Particularly, when a metal complex is used as the aggregating agent, the amount of the surfactant used is reduced and charging characteristics are improved.

An additive for forming a complex or a bond similar thereto with a metal ion of the aggregating agent may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and more preferably 0.1 parts by weight or more and less than 3.0 parts by weight, with respect to 100 parts by weight of the resin particles.

—Coalescence Step—

Next, the aggregated particle dispersion in which the aggregated particles are dispersed is heated at, for example, a temperature that is the glass transition temperature of the resin particles or higher (for example, not less than a temperature which is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming second aggregated particles in such a manner that an aggregated particle dispersion in which the aggregated particles are dispersed is obtained, the aggregated particle dispersion and a resin particle dispersion in which resin particles are dispersed are mixed, and aggregation is performed such that the resin particles attach on the surface of the aggregated particles, and a step of forming the toner particles having a core/shell structure by heating a second aggregated particle dispersion in which the second aggregated particles are dispersed to coalesce the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles, if necessary. The mixing may be performed with, for example, a V-blender, a HENSCHEL mixer, a LODIGE mixer, or the like. Furthermore, if necessary, coarse particles of the toner may be removed by using a vibration classifier, a wind classifier, or the like.

<Electrostatic Charge Image Developer>

The electrostatic charge image developer according to the exemplary embodiment contains at least the toner according to the exemplary embodiment.

The electrostatic charge image developer according to the exemplary embodiment may be a single-component developer containing only the specific toner, or a two-component developer obtained by mixing the specific toner with a carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the aforementioned carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin formed by containing an organosiloxane bond, or a modified product thereof, a fluorine resin, polyester, polycarbonate, a phenol resin, and an epoxy resin.

Note that, other additives such as the conductive particles may be contained in the coating resin and the matrix resin.

Examples of the conductive particles include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer-forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer-forming solution, a spray method of spraying the coating layer-forming solution onto the surface of the core, a fluid-bed method of spraying the coating layer-forming solution to the core in a state of being floated by the fluid air, and a kneader coating method of mixing the core of the carrier with the coating layer-forming solution and removing a solvent in the kneader coater.

The mixing ratio (weight ratio) of the toner to the carrier in the two-component developer is preferably in a range of toner:carrier=1:100 to 30:100, and is further preferably in a range of 3:100 to 20:100.

<Image Forming Apparatus/Image Forming Method>

An image forming apparatus/image forming method according to the exemplary embodiment will be described.

The image forming apparatus according to the exemplary embodiment includes an image holding member, a charging unit that charges a surface of the image holding member, an electrostatic charge image forming unit that forms an electrostatic charge image on the surface of the charged image holding member, a developing unit that contains an electrostatic charge image developer and develops an electrostatic charge image formed on the surface of the image holding member as a toner image with the electrostatic charge image developer, a transfer unit that transfers the toner image formed on the surface of the image holding member to a surface of a recording medium, and a fixing unit that fixes the toner image transferred to the surface of the recording medium. In addition, the electrostatic charge image developer according to the exemplary embodiment is applied as the electrostatic charge image developer.

In the image forming apparatus according to the exemplary embodiment, an image forming method (image forming method according to the exemplary embodiment) including charging a surface of the image holding member, forming an electrostatic charge image on the surface of the charged image holding member, developing an electrostatic charge image formed on the surface of the image holding member as a toner image with an electrostatic charge image developer according the exemplary embodiment, transferring the toner image formed on the surface of the image holding member to a surface of a recording medium, and fixing the toner image transferred to the surface of the recording medium is performed.

As the image forming apparatus according to the exemplary embodiment, well-known image forming apparatuses such as a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the surface of the intermediate transfer member to the surface of the recording medium; an apparatus provided with a cleaning unit that cleans the surface of the image holding member before being charged and after transferring the toner image; and an apparatus provided with an erasing unit that erases charges by irradiating the image holding member with erasing light before being charged and after transferring the toner image.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium.

In the image forming apparatus according to the exemplary embodiment, for example, a portion including the developing unit may be a cartridge structure (process cartridge) that is detachable from the image forming apparatus. As the process cartridge, for example, a process cartridge provided with a developing unit that stores the electrostatic charge image developer according to the exemplary embodiment is preferably used.

Hereinafter, an example of the image forming apparatus according to the exemplary embodiment will be described, but the exemplary embodiment is not limited thereto. The main parts illustrated in the drawings will be described, and the description of the other parts will be omitted.

FIG. 1 is a schematic configuration diagram illustrating an image forming apparatus according to the exemplary embodiment.

The image forming apparatus as illustrated in FIG. 1 is provided with electrophotographic type of first to fourth image forming units 10Y, 10M, 10C, and 10K (image forming units) that output images of the respective colors of yellow (Y), magenta (M), cyan (C), and black (K) based on color-separated image data. These image forming units 10Y, 10M, 10C, and 10K (hereinafter, simply referred to as a "unit" in some cases) are arranged apart from each other by a predetermined distance in the horizontal direction. Note that, the units 10Y, 10M, 10C, and 10K may be the process cartridge which is detachable from the image forming apparatus.

As an intermediate transfer member, an intermediate transfer belt 20 passing through the respective units is extended upward in the drawing of the respective units 10Y, 10M, 10C, and 10K. The intermediate transfer belt 20 is provided to be wound by a support roller 24 coming in contact with a driving roller 22 and the inner surface of an intermediate transfer belt 20 which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound by both. Further, an intermediate transfer member cleaning device 30 is provided on the side surface of the image holding member of the intermediate transfer belt 20 so as to face the driving roller 22.

In each of developing devices (developing unit) 4Y, 4M, 4C, and 4K of the each of the units 10Y, 10M, 10C, and 10K, four colors toner of yellow, magenta, cyan, and black stored in toner cartridges 8Y, 8M, 8C, and 8K are correspondingly supplied to each of the developing devices 4Y, 4M, 4C, and 4K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y includes a photoreceptor TY acting as an image holding member. In the vicinity of the photoreceptor 1Y, a charging roller (an example of the charging unit) 2Y which charges the surface of the photoreceptor TY with a predetermined potential, an exposure device (an example of the electrostatic charge image forming unit) 3 which exposes the charged surface by using a laser beam 3Y based on color separated image signal so as to form an electrostatic charge image, a developing device (an example of the developing unit) 4Y which supplies the charged toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the residues remaining on the surface of the photoreceptor Y after primary transfer are sequentially disposed.

Note that, the primary transfer roller 5Y is disposed inside the intermediate transfer belt 20, and is provided at a position facing the photoreceptor 1Y. Further, bias power supply (not shown) which is applied to the primary transfer bias is connected to each of the primary transfer rollers 5Y, 5M, 5C, and 5K. The bias power supply is changed to the transfer bias which is applied to applying to the primary transfer roller by control of a control unit (not shown).

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by laminating a photosensitive layer on a conductive (for example, volume resistivity at 20° C.: $1\times10^{-6}$ Ωcm or less) substrate. This photosensitive layer usually has a high resistance (resistance of a general resin), but has a property that when irradiated with the laser beam 3Y, the specific resistance of the portion irradiated with the laser beam changes. In this regard, in accordance with image data for yellow transmitted from the control unit (not shown), the laser beam 3Y is output to the charged surface of the photoreceptor 1Y via the exposure device 3. The photosensitive layer of the surface of the photoreceptor 1Y is irradiated with the laser beam 3Y, and thereby, the electrostatic charge image of a yellow image pattern is formed on the surface of the photoreceptor 1Y.

The electrostatic charge image means an image formed on the charged surface of the photoreceptor 1Y, in which resistivity of a portion of the photosensitive layer to be irradiated with the laser beam 3Y is decreased, and the charges for charging the surface of the photoreceptor 1Y flow; on the other hand, electrostatic charge image means a so-called negative latent image which is formed when charges of a portion which is not irradiated with the laser beam 3Y remain.

The electrostatic charge image formed on the photoreceptor 1Y is rotated to the predetermined developing position in accordance with the traveling of the photoreceptor 1Y. Further, the developing position, the electrostatic charge image on the photoreceptor 1Y is visualized (developed) as a toner image by the developing device 4Y.

The developing device 4Y stores, for example, a electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, so that the electrostatic charge image is developed with the yellow toner. Next, the photoreceptor 1Y having the yellow toner image formed thereon continuously travels at a predetermined rate and the toner image developed on the photoreceptor 1Y is supplied to a predetermined primary transfer position.

When the yellow toner image on the photoreceptor 1Y is transported to the primary transfer, a primary transfer bias is applied to the primary transfer roller 5Y, and an electrostatic force from the photoreceptor 1Y to the primary transfer roller 5Y acts on the toner image. The toner image on the photoreceptor 1Y is transferred onto the intermediate transfer belt 20. The transfer bias applied at this time has a polarity (+) opposite to the polarity (−) of the toner. For example, in the first unit 10Y, the control unit (not shown) controls the transfer bias to +10 μA.

On the other hand, the toner remaining on the photoreceptor 1Y is removed and collected by the photoreceptor cleaning device 6Y.

Further, the primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially supplied through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20. Meanwhile, a recording sheet (an example of the recording medium) P is supplied to a gap between the secondary transfer roller 26 and the intermediate transfer belt 20, that are brought into contact with each other, via a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a nip portion (nip part) between a pair of fixing rollers in a fixing device (an example of the fixing unit) 28 so that the toner image is fixed to the recording sheet P, so that a fixed image is formed.

Examples of the recording sheet P to which the toner image is transferred include plain paper that is used in electrophotographic copying machine, printers, and the like, and as a recording medium. An OHP sheet is also exemplified as the recording medium in addition to the recording sheet P.

In order to further improve the smoothness of the image surface after fixing, the surface of the recording sheet P is also preferably smooth. For example, coated paper in which the surface of plain paper is coated with a resin or the like, art paper for printing, and the like are preferably used.

The recording sheet P on which the fixing of the color image is completed is discharged toward a discharge part, and a series of the color image forming operations end.

<Process Cartridge/Toner Cartridge>

The process cartridge according to the exemplary embodiment will be described.

The process cartridge according to the exemplary embodiment that stores the electrostatic charge image developer according to the exemplary embodiment includes a developing unit that contains the electrostatic charge image developer according to the exemplary embodiment and develops an electrostatic charge image formed on the surface of an image holding member as a toner image with the electrostatic charge image developer, the process cartridge is detachable from the image forming apparatus.

The process cartridge according to the exemplary embodiment is not limited to the above-described configuration, and may have a configuration of including a developing device and, as needed, at least one selected from other units such as an image holding member, a charging unit, an electrostatic charge image forming unit, and a transfer unit.

Hereinafter, an example of the process cartridge according to the exemplary embodiment will be shown. However, the process cartridge is not limited thereto. The main parts illustrated in the drawings will be described, and the description of the other parts will be omitted.

Figure 2:
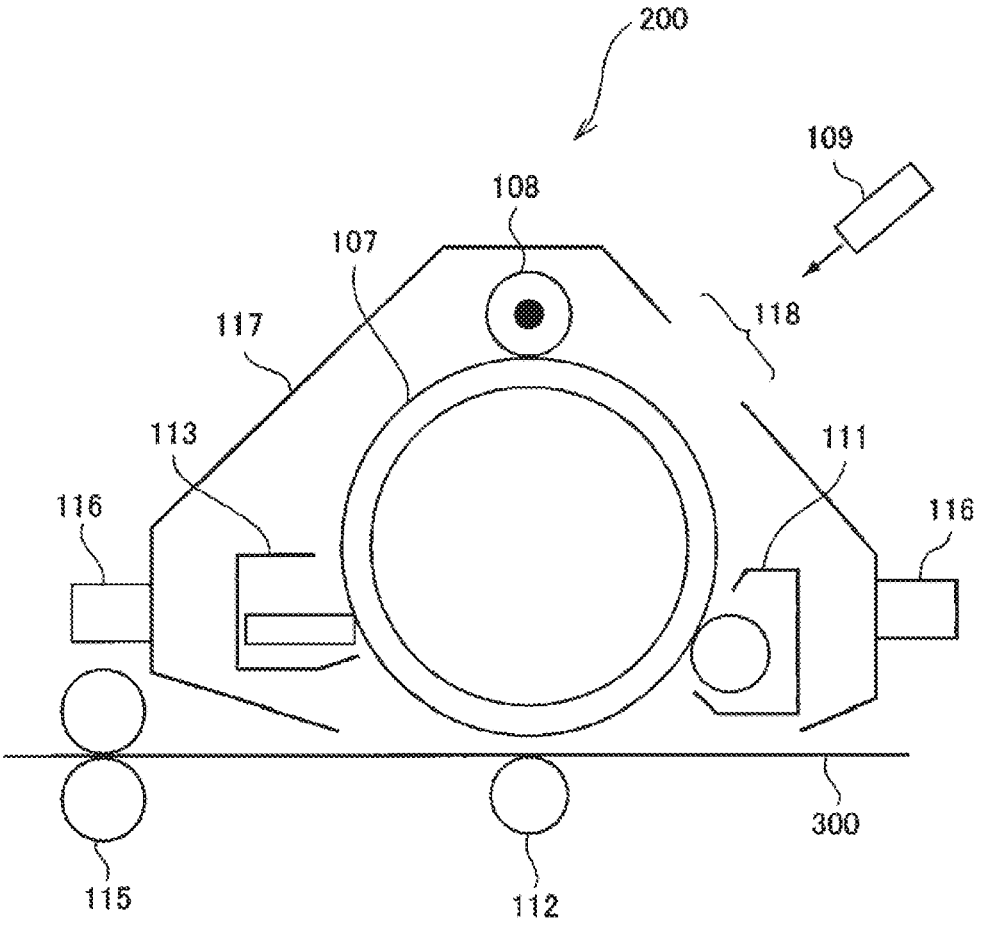
FIG. 2 is a schematic configuration diagram illustrating an example of a process cartridge according to the exemplary embodiment.

FIG. 2 is a schematic configuration diagram illustrating a process cartridge according to the exemplary embodiment.

The process cartridge 200 illustrated in FIG. 2 is configured such that an photoreceptor 107 (an example of the image holding member), a charging roller 108 (an example of the charging unit) which is provided in the vicinity of the electrophotographic photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 2, reference numeral 109 is denoted as an exposing device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, a toner cartridge according to the exemplary embodiment will be described.

The toner cartridge according to the exemplary embodiment is a toner cartridge that stores the toner according to the exemplary embodiment and is detachable from the image forming apparatus. The toner cartridge stores a toner for replenishment to be supplied to the developing unit provided in the image forming apparatus.

The image forming apparatus illustrated in FIG. 1 is an image forming apparatus having a configuration in which toner cartridges 8Y, 8M, 8C, and 8K are detachable from the image forming apparatus, and the developing devices 4Y, 4M, 4C, and 4K are connected to toner cartridges corresponding to the respective developing devices (colors) through a toner supply pipe (not shown). In addition, in a case where the amount of toner stored in the toner cartridge becomes low, the toner cartridge is replaced.

EXAMPLES

Hereinafter, the exemplary embodiment will be more specifically described with reference to Examples and Comparative Examples; however, the exemplary embodiment is not limited thereto. Note that, "part" indicating weight and "%" are based on weight unless otherwise noted.

<Preparation of Toner Particles>

(Preparation of Toner Particles (1))

[Preparation of Resin Particle Dispersion (1)]

Ethylene glycol (Wako Pure Chemical Industries, Ltd.): 37 parts

Neopentyl glycol (Wako Pure Chemical Industries, Ltd.): 65 parts 1,9-nonanediol (Wako Pure Chemical Industries, Ltd.): 32 parts Terephthalic acid (Wako Pure Chemical Industries, Ltd.): 96 parts The above materials are charged into a flask, the temperature is raised to 200° C. over 1 hour, and after checking that the inside of a reaction system is uniformly stirred, 1.2 parts of dibutyltin oxide is charged thereinto. The temperature is raised to 240° C. over 6 hours while distilling off generated water and the stirring is continued at 240° C. for 4 hours to obtain a polyester resin (acid value: 9.4 mg KOH/g, weight average molecular weight: 13,000, glass transition temperature: 62° C.). In a molten state, the polyester resin is transferred to an emulsifying/dispersing machine (CAVITRON CD1010, Eurotec Limited) at a rate of 100 g/min. Separately, 0.37% dilute ammonia aqueous solution obtained by diluting reagent ammonia aqueous solution with ion exchanged water is put into a tank, and transferred to the emulsifying and dispersing machine simultaneously with the polyester resin at a rate of 0.1 liter per minute while heating to 120° C. with a heat exchanger. The emulsifying and dispersing machine is operated under the conditions of a rotor rotation speed of 60 Hz and a pressure of 5 kg/cm$^2$ to obtain a resin particle dispersion (1) having a volume average particle diameter of 160 nm and a solid content of 30%.

[Preparation of Resin Particle Dispersion (2)]

Decandioic acid (Tokyo Chemical Industry Co., Ltd.): 81 parts

Hexanediol (Wako Pure Chemical Industries, Ltd.): 47 parts

The above materials are charged into a flask, the temperature is raised to 160° C. over 1 hour, and after checking that the inside of a reaction system is uniformly stirred, 0.03 parts of dibutyltin oxide is charged thereinto. The temperature is raised to 200° C. over 6 hours while distilling off generated water, and the stirring is continued at 200° C. for 4 hours. Next, the reaction solution is cooled, solid-liquid separation is performed, and the solid is dried at a temperature of 40° C. and under reduced pressure to obtain a polyester resin (C1) (melting point: 64° C., weight average molecular weight: 15,000).

Polyester resin (C1): 50 parts

Anionic surfactant (NEOGEN SC, Dai-Ichi Kogyo Seiyaku Co., Ltd.): 2 parts

Ion exchanged water: 200 parts

The above materials are heated at 120° C., sufficiently dispersed with a homogenizer (ULTRA TURRAX T50, IKA), and then dispersed with a pressure discharge type homogenizer. When the volume average particle diameter became 180 nm, the particles are collected to obtain a resin particle dispersion (2) having a solid content of 20%.

[Preparation of Coloring Agent Particle Dispersion (1)]

Cyan Pigment (Pigment Blue 15:3, Dainichiseika Color & Chemicals Mfg. Co., Ltd.): 10 parts Anionic surfactant (NEOGEN SC, Dai-Ichi Kogyo Seiyaku Co., Ltd.): 2 parts Ion exchanged water: 80 parts The above materials are mixed and dispersed for 1 hour by using a high-pressure impact disperser Ultimaizer (HJP30006, manufactured by Sugino Machine Ltd.) to obtain a coloring agent particle dispersion (1) having a volume average particle diameter of 180 nm and a solid content of 20%.

[Preparation of Release Agent Particle Dispersion (1)]

Paraffin wax (HNP-9, Nippon Seiro, Co., Ltd.): 50 parts

Anionic surfactant (NEOGEN SC, Dai-Ichi Kogyo Seiyaku Co., Ltd.): 2 parts

Ion exchanged water: 200 parts

The above materials are heated at 120° C., sufficiently dispersed with a homogenizer (ULTRA TURRAX T50, IKA), and then dispersed with a pressure discharge type homogenizer. When the volume average particle diameter became 200 nm, the particles are collected to obtain a release agent particle dispersion (1) having a solid content of 20%.

[Preparation of Toner Particle (1)]

Resin particle dispersion (1): 150 parts

Resin particle dispersion (2): 50 parts

Coloring agent particle dispersion (1): 25 parts

Release agent particle dispersion (1): 35 parts

Polyaluminum chloride: 0.4 parts

Ion exchanged water: 100 parts

The above materials are charged into a round stainless steel flask, and thoroughly mixed and dispersed using a homogenizer (ULTRA TURRAX T50, IKA), and then the mixture is heated to 48° C. in a heating oil bath while stirring. After keeping the inside of the reaction system at 48° C. for 60 minutes, 70 parts of the resin particle dispersion (1) is slowly added. Then, the pH is adjusted to 8.0 with a 0.5 mol/L aqueous sodium hydroxide solution, the flask is closed, a seal of a stirring shaft is magnetically sealed, and the mixture is heated to 90° C. while continuously stirring and kept for 30 minutes. Next, the mixture is cooled at a cooling rate of 5° C./min, subjected to solid-liquid separation, and washed sufficiently with ion exchanged water. Next, the mixture is subjected to solid-liquid separation, redispersed in ion exchanged water at 30° C., and washed by stirring at a rotation speed of 300 rpm for 15 minutes. This washing operation is further repeated six times. When the pH of the filtrate becomes 7.54 and the electric conductivity became 6.5 μS/cm, the solid-liquid separation is performed, and vacuum drying is continued for 24 hours to obtain a toner particle (1) having a volume average particle diameter of 4.6 μm and an average circularity of 0.968.

(Preparation of Toner Particles (2) to (7))

The toner particles (2) to (6) having the following average circularity and volume average particle diameter are obtained in the same manner as in the preparation of the toner particle (1) except for changing the keeping time in the coalescence step.

Toner particle (2); Volume average particle diameter: 4.6 μm, average circularity: 0.998

Toner particle (3); Volume average particle diameter: 4.6 μm, average circularity: 0.961

Toner particles (4); Volume average particle diameter: 6.3 μm, average circularity: 0.964

Toner particles (5); Volume average particle diameter: 5.2 μm, average circularity: 0.967

Toner particles (6); Volume average particle diameter: 4.6 μm, average circularity: 0.958

Toner particles (7); Volume average particle diameter: 7.9 μm, average circularity: 0.968

<Preparation of Organic Particle>

(Preparation of Organic Particle (1))

A commercially available straight-chain aliphatic higher alcohol is purified by a rectification method to obtain higher alcohol particles ($CH_3(CH_2)_{50}CH_2OH$). These particles are pulverized to 100 μm by a jet pulverizer and further subjected to spheroidization treatment with warm air to obtain a spherical particle. Further, it is pulverized by a jet pulverizer to obtain an organic particle (1) having the properties indicated in Table 1.

(Preparation of Organic Particles (2), (5), (6), (10), and (11))

By classifying the organic particles (1), organic particles (2), (5), (6), (10), and (11) having the properties indicated in Table 1 are prepared.

(Preparation of Organic Particles (3), (4), and (16))

Commercially available melamine cyanurate is pulverized and classified by a jet mill to obtain organic particles (3), (4), and (16) having the properties indicated in Table 1.

(Preparation of Organic Particle (12))

In the preparing method of organic particle (1), higher alcohol particle ($CH_3$ $(CH_2)_{59}CH_2OH$) is used to obtain an organic particle (12) having the properties indicated in Table 1.

(Preparation of Organic Particle (13))

In the preparing method of organic particle (1), higher alcohol particle ($CH_3$ $(CH_2)_{20}CH_2OH$) is used to obtain an organic particle (13) having the properties indicated in Table 1.

(Preparation of Organic Particle (14))

In the preparing method of organic particle (1), higher alcohol particle ($CH_3$ $(CH_2)_{63}CH_2OH$) is used to obtain an organic particle (14) having the properties indicated in Table 1.

(Preparation of Organic Particle (15))

In the preparing method of organic particle (1), higher alcohol particle ($CH_3$ $(CH_2)_{17}CH_2H$) is used to obtain an organic particle (15) having the properties indicated in Table 1.

(Preparation of Organic Particle (7))

In the preparing method of the organic particle (1), the particle diameter before the spherical treatment is set to 200 μm to obtain the organic particle (7) having the properties indicated in Table 1.

(Preparation of Organic Particle (8))

In the preparing method of the organic particle (1), the particle diameter before the spherical treatment is set to 50 μm to obtain the organic particle (8) having the properties indicated in Table 1.

(Preparation of Comparative Organic Particle (C1))

A commercially available straight-chain aliphatic higher alcohol is purified by a rectification method to obtain higher alcohol particles ($CH_3(CH_2)_{50}CH_2OH$). The particles are pulverized by a jet pulverizer to obtain a comparative organic particle (C1) having the properties indicated in Table 1.

(Preparation of Comparative Organic Particle (C2))

In the preparing method of the organic particle (1), the particle diameter before the spherical treatment is set to 15 μm to obtain the comparative organic particle (C2) having the properties indicated in Table 1.

<Silica Particles>

The following silica particles are prepared.

Silica particles (1): Volume average particle diameter=40 nm, manufactured by Nippon Aerosil Co., Ltd.

Silica particles (2): Volume average particle diameter=100 nm, manufactured by Nippon Aerosil Co., Ltd.

Silica particles (3): Volume average particle diameter=80 nm, Nippon Aerosil Co., Ltd.

Examples 1 to 24, and Comparative Examples 1 to 3

In a combination number indicated in Table 1, 100 parts of toner particles, organic particles, and silica particles are mixed with a HENSCHEL mixer to obtain a toner.

Next, using the toner of each example, a developer of each example is obtained as follows.

(Preparation of Carrier)

Mn—Mg—Sr-based ferrite particle (average particle diameter: 40 μm): 100 parts

Toluene: 14 parts

Cyclohexyl methacrylate/dimethylaminoethyl methacrylate copolymer (copolymer weight ratio 99:1, weight average molecular weight Mw 80,000): 2.0 parts Carbon black (VXC72: manufactured by Cabot Corporation): 0.12 parts The above components excluding ferrite particles and glass beads ($1 mm, the same amount as toluene) are mixed using a sand mill manufactured by Kansai Paint Co., Ltd., and stirred at 1,200 ppm for 30 minutes to obtain a resin coating layer-forming solution. Further, the resin coating layer-forming solution and the ferrite particles are placed in a vacuum degassing type kneader, the pressure is reduced, and toluene is distilled off and dried to form a carrier.

(Preparation of Developer)

40 Parts of toner is added to 500 parts of carrier, blended with a V-type blender for 20 minutes, and then aggregates are removed with a vibration sieve having openings of 212 μm to obtain a developer.

<Evaluation>

The following evaluations are performed on the developer of each example. The results are shown in Table 1.

(Evaluation of Generation of Density Unevenness)

The developer of each example is stored in a developing unit of "DocuPrintCP400ps" manufactured by Fuji Xerox Co., Ltd.

Then, after controlling the humidity for 17 hours in a high-temperature and high-humidity environment (30° C., 70% RH environment) using this apparatus, 10000 evaluation charts (specifically, a grid-like line chart) having an image density of 1% are output on both sides of P paper (manufactured by Fuji Xerox Co., Ltd.).

Then, on the next day, three halftone images having an image density of 50% are output on one side of P paper (manufactured by Fuji Xerox Co., Ltd.).

Then, the 50% halftone images output on the three P papers are evaluated according to the following evaluation criteria.

A: There is no density shading, and the density difference between two locations is 0.03 or less B: Streaks are seen depending on the angle, but the density difference between the streak portion and other locations is 0.05 or less C: Streaks are seen depending on the angle, but the density difference between the streak portion and other locations is 0.10 or less D: Streaks are checked, and the density difference between the streak portion and other locations is 0.20 or less E: There is a streak, and the density difference between the streak portion and other locations is greater than 0.20

TABLE 1

| | Toner particles | | | Organic particles | | | | |
|---|---|---|---|---|---|---|---|---|
| | Types | TD50v μm | Average circularity | Types | Material | Number of parts | Aspect ratio AR | Average major axis MA μm |
| Example 1 | 1 | 4.6 | 0.968 | 2 | $CH_3(CH_2)_{50}CH_2OH$ | 1.2 | 0.72 | 5.2 |
| Example 2 | 2 | 4.6 | 0.998 | 2 | $CH_3(CH_2)_{50}CH_2OH$ | 1.2 | 0.72 | 5.2 |
| Example 3 | 3 | 4.6 | 0.961 | 2 | $CH_3(CH_2)_{50}CH_2OH$ | 1.2 | 0.72 | 5.2 |
| Example 4 | 1 | 4.6 | 0.968 | 9 | $CH_3(CH_2)_{50}CH_2OH$ | 1.2 | 0.88 | 5.6 |
| Example 5 | 1 | 4.6 | 0.968 | 10 | $CH_3(CH_2)_{50}CH_2OH$ | 1.2 | 0.41 | 5.4 |
| Example 6 | 7 | 7.9 | 0.968 | 2 | $CH_3(CH_2)_{50}CH_2OH$ | 0.9 | 0.72 | 5.2 |
| Example 7 | 1 | 4.6 | 0.968 | 3 | Melamine cyanurate | 2 | 0.72 | 6.3 |
| Example 8 | 1 | 4.6 | 0.968 | 4 | Melamine cyanurate | 0.4 | 0.62 | 5.2 |
| Example 9 | 4 | 6.3 | 0.964 | 11 | $CH_3(CH_2)_{50}CH_2OH$ | 0.8 | 0.63 | 8.2 |
| Example 10 | 4 | 6.3 | 0.964 | 12 | $CH_3(CH_2)_{59}CH2OH$ | 0.8 | 0.66 | 8.3 |
| Example 11 | 4 | 6.3 | 0.964 | 13 | $CH_3(CH_2)_{20}CH_2OH$ | 0.8 | 0.72 | 8.4 |
| Example 12 | 4 | 6.3 | 0.964 | 14 | $CH_3(CH_2)_{63}CH_2OH$ | 0.8 | 0.65 | 7.9 |
| Example 13 | 4 | 6.3 | 0.964 | 15 | $CH_3(CH_2)_{17}CH_2OH$ | 0.8 | 0.8 | 7.7 |
| Example 14 | 5 | 5.2 | 0.967 | 14 | $CH_3(CH_2)_{63}CH_2OH$ | 0.8 | 0.65 | 7.8 |
| Example 15 | 5 | 5.2 | 0.967 | 5 | $CH_3(CH_2)_{50}CH_2OH$ | 0.8 | 0.69 | 4.2 |
| Example 16 | 4 | 6.3 | 0.964 | 6 | $CH_3(CH_2)_{50}CH_2OH$ | 0.9 | 0.76 | 10.8 |
| Example 17 | 4 | 6.3 | 0.964 | 7 | $CH_3(CH_2)_{50}CH_2OH$ | 1.8 | 0.87 | 3.1 |
| Example 18 | 4 | 6.3 | 0.964 | 1 | $CH_3(CH_2)_{50}CH_2OH$ | 0.9 | 0.76 | 11.6 |
| Example 19 | 4 | 6.3 | 0.964 | 8 | $CH_3(CH_2)_{50}CH_2OH$ | 1.8 | 0.85 | 2.8 |
| Example 20 | 4 | 6.3 | 0.964 | 16 | Melamine cyanurate | 1.2 | 0.62 | 5.2 |
| Example 21 | 4 | 6.3 | 0.964 | 16 | Melamine cyanurate | 1.2 | 0.62 | 5.2 |
| Example 22 | 4 | 6.3 | 0.964 | 16 | Melamine cyanurate | 1.2 | 0.62 | 5.2 |
| Example 23 | 4 | 6.3 | 0.964 | 16 | Melamine cyanurate | 1.2 | 0.62 | 5.2 |
| Example 24 | 4 | 6.3 | 0.964 | 16 | Melamine cyanurate | 1.2 | 0.62 | 5.2 |
| Comparative Example 1 | 1 | 4.6 | 0.968 | C1 | $CH_3(CH_2)_{50}CH_2OH$ | 2.6 | 0.92 | 5.2 |
| Comparative Example 2 | 6 | 4.6 | 0.958 | 1 | $CH_3(CH_2)_{50}CH_2OH$ | 1.2 | 0.72 | 5.2 |
| Comparative Example 3 | 1 | 4.6 | 0.968 | C2 | $CH_3(CH_2)_{50}CH_2OH$ | 0.3 | 0.38 | 5.3 |

| | Organic particles | | Silica particles | | | Content of irregular toner particles | Evaluation |
|---|---|---|---|---|---|---|---|
| | MA/TD50v | OS temperature ° C. | Types | Number of parts | SD50v nm | (% by number) | Generation of density unevenness |
| Example 1 | 1.13 | 82 | 1 | 1.2 | 40 | 4.8 | A |
| Example 2 | 1.13 | 82 | 1 | 1.2 | 40 | 4.3 | C |
| Example 3 | 1.13 | 82 | 1 | 1.2 | 40 | 5.1 | B |
| Example 4 | 1.22 | 82 | 1 | 1.2 | 40 | 4.8 | B |
| Example 5 | 1.17 | 82 | 1 | 1.2 | 40 | 3.2 | B |
| Example 6 | 0.66 | 82 | 1 | 1.2 | 40 | 5.1 | B |
| Example 7 | 1.37 | — | 1 | 1.2 | 40 | 9.8 | B |
| Example 8 | 1.13 | — | 1 | 1.2 | 40 | 2.1 | B |
| Example 9 | 1.30 | 82 | 1 | 0.8 | 40 | 3.2 | A |
| Example 10 | 1.32 | 90 | 1 | 0.8 | 40 | 3.6 | B |
| Example 11 | 1.33 | 51 | 1 | 0.8 | 40 | 3.3 | B |
| Example 12 | 1.25 | 92 | 1 | 0.8 | 40 | 3.2 | C |
| Example 13 | 1.22 | 44 | 1 | 0.8 | 40 | 3.8 | C |
| Example 14 | 1.50 | 92 | 1 | 0.8 | 40 | 4.2 | B |
| Example 15 | 0.81 | 82 | 1 | 0.8 | 40 | 4.9 | B |
| Example 16 | 1.71 | 82 | 2 | 1 | 100 | 7.2 | C |
| Example 17 | 0.49 | 82 | 2 | 1 | 100 | 2.6 | A |
| Example 18 | 1.84 | 82 | 3 | 1 | 80 | 7.3 | C |
| Example 19 | 0.44 | 82 | 3 | 1 | 80 | 2.6 | C |
| Example 20 | 0.83 | — | 1 | 1.2 | 40 | 4.8 | A |
| Example 21 | 0.83 | — | 1 | 0.4 | 40 | 4.8 | B |
| Example 22 | 0.83 | — | 1 | 1.9 | 40 | 4.8 | B |
| Example 23 | 0.83 | — | 1 | 0.3 | 40 | 4.8 | C |
| Example 24 | 0.83 | — | 1 | 2.2 | 40 | 4.8 | C |
| Comparative Example 1 | 1.13 | 82 | 1 | 1.2 | 40 | 11.2 | D |
| Comparative Example 2 | 1.13 | 82 | 1 | 1.2 | 40 | 4.9 | E |
| Comparative Example 3 | 1.15 | 82 | 1 | 1.2 | 40 | 1.8 | E |

According to the above results, it is found that in the examples, the generation of density unevenness is prevented as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles having an average circularity of 0.96 to 1.00; and organic particles having an aspect ratio of 0.4 to 0.6 as an external additive, wherein the average major axis of the organic particles is from 3.0 μm to 11.0 μm.

2. An electrostatic charge image developing toner comprising:

toner particles having an average circularity of 0.96 to 1.00; and organic particles as an external additive, wherein among the toner particles, a content of toner particles which have a particle diameter not less than a number particle diameter D84p, which is a particle diameter when a cumulative percentage reaches 84% in a cumulative frequency based on the number of the toner particles having the organic particles attached to or mixed with in terms of a circle equivalent diameter, and have an average circularity of 0.90 or less, provided that the average circularity is based on the toner particles having the organic particles attached to or mixed with, is 2.0% by number to 10.0% by number with respect to entire toner particles.

3. The electrostatic charge image developing toner according to claim 1, wherein in a differential scanning calorific curve of the organic particles, an onset temperature of a maximum endothermic peak during a temperature rise is from 45° C. to 90° C.

4. The electrostatic charge image developing toner according to claim 1, wherein a ratio of an average major axis of the organic particles to a volume average particle diameter of the toner particles (average major axis of organic particles/volume average particle diameter of toner particles) is from 0.7 to 1.8.

5. The electrostatic charge image developing toner according to claim 4, wherein the ratio of the average major axis of the organic particles to the volume average particle diameter of the toner particles (average major axis of organic particles/volume average particle diameter of toner particles) is from 0.8 to 1.5.

6. The electrostatic charge image developing toner according to claim 1, wherein an amount of the organic particles added as the external additive is from 0.4% by weight to 2.0% by weight with respect to the toner particles.

7. The electrostatic charge image developing toner according to claim 1, wherein the organic particles are higher alcohol particles.

8. The electrostatic charge image developing toner according to claim 7, wherein the higher alcohol particles are particles of a higher alcohol represented by Formula (AC): $CH_3(CH_2)xCH_2OH$, wherein x represents an integer of 20 to 80.

9. The electrostatic charge image developing toner according to claim 1, further comprising:

silica particles as the external additive.

10. The electrostatic charge image developing toner according to claim 9, wherein a volume average particle diameter of the silica particles is from 40 nm to 120 nm.

11. An electrostatic charge image developer comprising:

the electrostatic charge image developing toner according to claim 1.

12. The electrostatic charge image developing toner according to claim 2, wherein in a differential scanning calorific curve of the organic particles, an onset temperature of a maximum endothermic peak during a temperature rise is from 45° C. to 90° C.

13. The electrostatic charge image developing toner according to claim 2, wherein a ratio of an average major axis of the organic particles to a volume average particle diameter of the toner particles (average major axis of organic particles/volume average particle diameter of toner particles) is from 0.7 to 1.8.

14. The electrostatic charge image developing toner according to claim 13, wherein the ratio of the average major axis of the organic particles to the volume average particle diameter of the toner particles (average major axis of organic particles/volume average particle diameter of toner particles) is from 0.8 to 1.5.

15. The electrostatic charge image developing toner according to claim 2, wherein the average major axis of the organic particles is from 3.0 μm to 11.0 μm.

16. The electrostatic charge image developing toner according to claim 2, wherein an amount of the organic particles added as the external additive is from 0.4% by weight to 2.0% by weight with respect to the toner particles.

17. The electrostatic charge image developing toner according to claim 2, wherein the organic particles are higher alcohol particles.

18. The electrostatic charge image developing toner according to claim 17, wherein the higher alcohol particles are particles of a higher alcohol represented by Formula (AC): $CH_3(CH_2)xCH_2OH$, wherein x represents an integer of 20 to 80.

19. An electrostatic charge image developer comprising:

the electrostatic charge image developing toner according to claim 2.

* * * * *